United States Patent [19]

Daily

[11] 4,109,397

[45] Aug. 29, 1978

[54] ROTATABLE, NON-TUMBLING DRYING RACK

[75] Inventor: Thomas Edward Daily, Herrin, Ill.

[73] Assignee: Fedders Corporation, Edison, N.J.

[21] Appl. No.: 766,939

[22] Filed: Feb. 9, 1977

[51] Int. Cl.[2] ..... F26B 23/04

[52] U.S. Cl. ..... 34/239; 34/133

[58] Field of Search ..... 68/4, 157; 34/133, 239, 34/237, 238; 220/19

[56] References Cited

U.S. PATENT DOCUMENTS

| | | | |
|---|---|---|---|
| 1,903,564 | 4/1933 | Shaffner | 68/4 |
| 1,917,829 | 7/1933 | Cole | 68/4 |
| 2,846,941 | 8/1958 | Goodwin | 220/19 |
| 3,316,659 | 5/1967 | Lauck | 34/133 |
| 3,344,532 | 10/1967 | Bigler | 34/133 |

*Primary Examiner*—John J. Camby
*Assistant Examiner*—Larry I. Schwartz
*Attorney, Agent, or Firm*—McAulay, Fields, Fisher & Goldstein

[57] ABSTRACT

A drying rack for a dryer of the type having a rotating drum. The rack is adapted to prevent the tumbling of articles received in the rack as the drum rotates. The rack comprises an open-work basket portion that receives the articles to be dried. The basket comprises a bottom wall, opposed side walls, a front wall and a rear wall. A cover is provided for closing the basket portion and cooperating closing means on the basket portion and the cover are provided for affixing the cover to the basket portion at a selected one of a plurality of different heights from the bottom wall. Accordingly, the cover pressure will maintain the articles in place and prevent relative motion therebetween regardless of the height of the pile of articles received in the basket. Additionally, mounting means is provided for releasably mounting the rack on the drum to prevent tumbling of the rack as the drum rotates.

8 Claims, 5 Drawing Figures

ROTATABLE, NON-TUMBLING DRYING RACK

BACKGROUND OF THE INVENTION

The present invention relates generally to a dryer construction and, more particularly, pertains to a dryer construction incorporating a rack for non-tumble drying of articles received in the rack.

Conventional home dryers and the like include a rotatable drum that receives the articles to be dried. During a normal drying cycle the drum rotates as hot air traverses through the drum. The rotation of the drum causes the articles to continuously circulate through the drum thereby exposing more surface area to quicken the drying process. This is normally referred to as a tumble dry operation.

However, many types of articles such as "dainty" articles cannot be subjected to a tumble drying operation without being damaged. As a result, these articles must be dried by other methods such as by a clothes rack or the like. Of course, it would be preferable if the ease of an automatic dryer could be used to accommodate such articles.

Accordingly, an object of this invention is to provide an improved dryer construction for the non-tumble drying of articles.

A more specific object of the invention is to provide a dryer construction having provision for conventional tumble drying cycles and for non-tumble drying Another object of this invention is to provide a dryer construction having a removable rack for the selective non-tumble drying of articles.

A further object of the present invention resides in the novel details of construction that provide a non-tumble drying rack in a dryer construction of the type described that effectively prevents the relative movement of articles received in the rack regardless of the amount of articles therein.

Accordingly, a rack constructed according to the present invention is adapted to be used in a dryer of the type having a rotatable drum for preventing tumbling of the articles received in the rack. The rack comprises an open-work basket portion for receiving the articles therein. The basket comprises a bottom wall, opposed side walls, a front wall and a rear wall. A cover is provided for covering the open top of the basket portion and cooperating closing means is provided on the basket portion and the cover for affixing the cover to the basket portion at a preselected one of a plurality of different heights from the bottom wall. Mounting means releasably mounts the rack on the drum to prevent the tumbling of the rack as the drum rotates. Since the cover may be affixed to the basket portion at a number of different locations, the pressure from the cover will prevent relative movement of the articles in the basket regardless of the volume occupied by the articles.

Other features and advantages of the present invention will become more apparent from a consideration of the following detailed description, when taken in conjunction with the accompanying drawings, in which.

Figure 1:
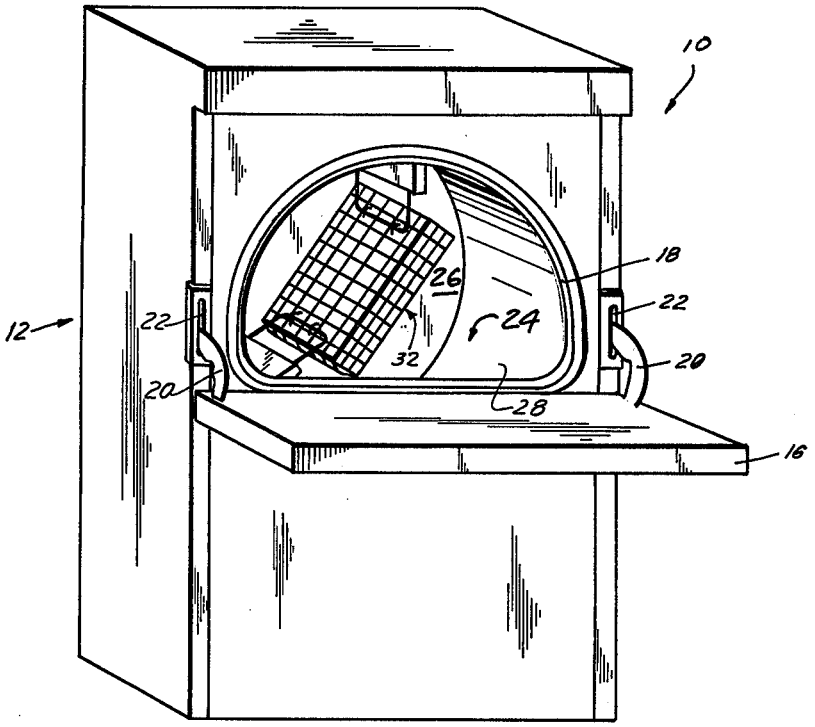
FIG. 1 is a perspective view of a dryer constructed according to the present invention, shown with the dryer door in the open position.

A dryer constructed according to the present invention is designated generally by the reference character 10 in FIG. 1 and comprises a cabinet 12 having a front wall 14. The front wall 14 is provided with a swing-down door 16 that permits access to the interior of the cabinet through an opening 18 in the front wall. As is conventional, the dryer door is movable between a closed position in which the opening 18 is closed, and the open position of FIG. 1. The dryer door may be maintained in the open position of FIG. 1 via brackets 20 which extend through slots 22 in the cabinet 12 and which are spring loaded to engage appropriate rollers (not shown) in a detent. Received within the cabinet 12 is a rotatable drum 24 that is adapted to receive the articles to be dried.

Figure 3:
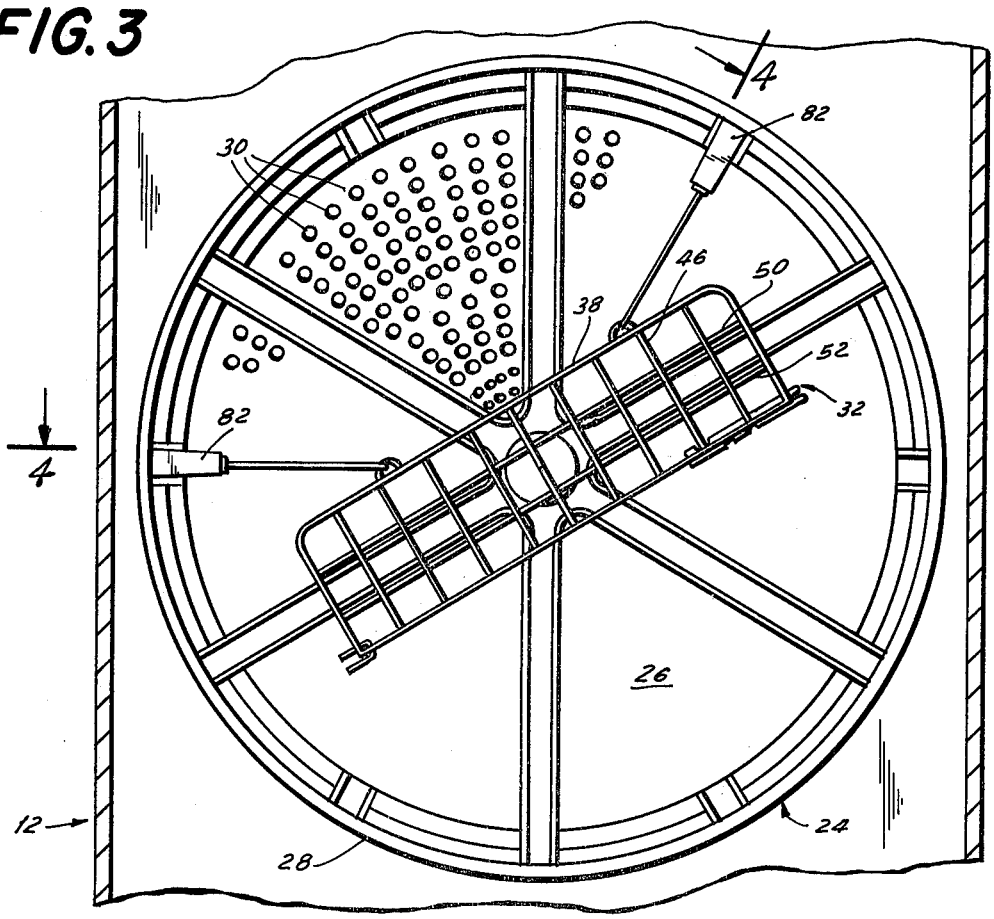
FIG. 3 is a vertical sectional view, to an enlarged scale, of the interior of the dryer drum, with parts broken away in the interests of clarity.

More specifically, as shown in FIG. 3, the drum 24 is provided with a rear wall 26 and a peripheral wall 28. The rear wall 26 contains openings 30 through which hot air is adapted to enter the drum. The air normally traverses the interior of the drum from the rear wall toward the front of the drum and drys the clothes received therein.

The dryer construction thus far described is conventional. In normal operation, the operator places the articles in the drum 24 through the opening 18 and then closes the door 16. A motor (not shown) begins to rotate the drum as the hot air blows through the drum. The rotating motion of the drum causes the articles received therein to circulate or tumble thereby continuously exposing the surfaces of the articles to the hot air and permitting the articles to be quickly dried.

However, as noted above, in many instances it is desired to utilize the efficiency of the dryer construction to dry articles that would otherwise be damaged by the tumbling process. Accordingly, a rack is provided that prevents the relative movement of the articles in the drum and yet subjects the articles to the hot air so that they may be dried quickly and efficiently.

To be more specific, the present invention includes a rack designated generally by the reference character 32. The rack 32 is removably retained within the drum 24 and is held stationary with respect thereto. Accordingly, articles received within the rack will be prevented from tumbling as the drum rotates but nonetheless will be subject to the drying action of the hot air.

Figure 2A:
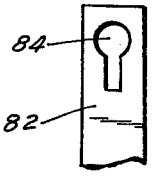
FIG. 2A is a detailed view of a portion of the mounting device showing the opening for receiving the rack arms.
Figure 2:
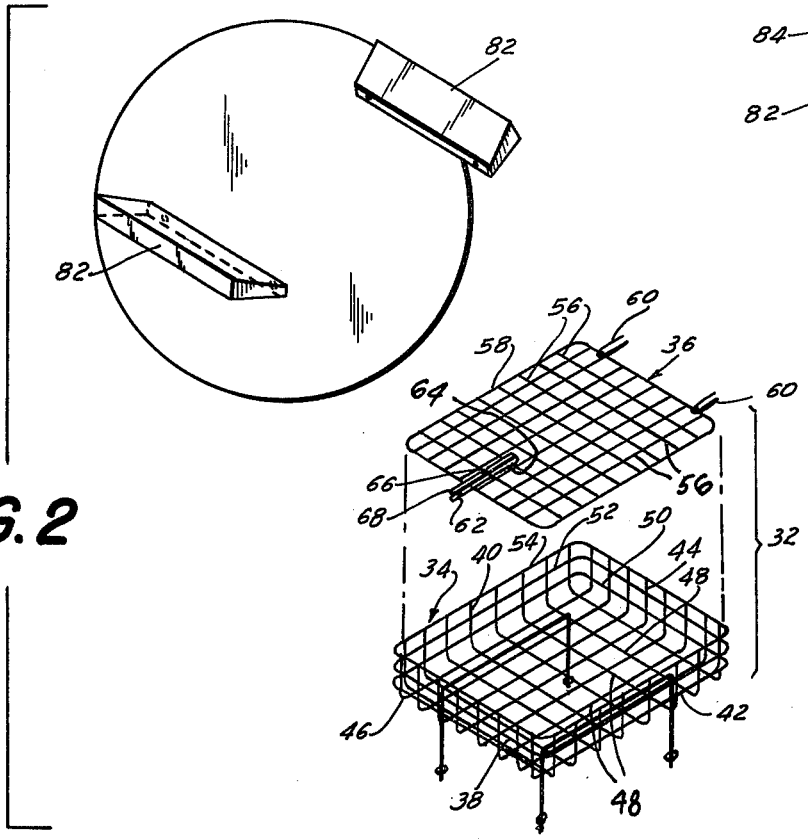
FIG. 2 is an exploded detailed view of the rack of the present invention showing the basket arrangement and the drum mounting device.

The rack 32, as shown in FIG. 2 comprises a basket portion 34 having an open top and a cover 36 that is adapted to close the open top of the basket portion. The basket portion comprises a bottom wall 38, opposed side walls 40 and 42, a front wall 44 and a rear wall 46. The bottom wall 38 is formed by a plurality of laterally and longitudinally extending rods 48 that are connected together where they cross each other. Additionally, the side walls 40 and 42, front wall 44 and rear wall 46 are formed in part by vertical extensions of the rods 48 and horizontally extending members 50, 52 and 54 that surround the vertical extensions of the rods 48 and are connected thereto where they cross each other. It will be noted that members 50, 52 and 54 are located at different heights above the bottom wall 38.

That is, as clearly shown in FIG. 2, the member 50 is located adjacent the bottom wall whereas the member 54 is furthest from the bottom wall and the member 52 is intermediate the members 50 and 54.

The cover 36 is of the open-work type similarly to the basket portion 34. The cover 36 comprises laterally and longitudinally extending rods 56 that are connected to each other at their points of intersection. Additionally, a member 58 extends about the periphery of the cover and is connected to the ends of the rods 56. The cover is adapted to close the open top of the basket portion 34 and may be located at any one of a number of heights from the bottom wall. In other words, the cover is provided with closing means that are adapted to engage any one of the horizontal members 50, 52 or 54 so that the cover is positioned at a height corresponding to the height of the particular member above the bottom wall 38.

To be more specific, the member 58 is provided with outwardly extending laterally spaced U-shaped hooks or bifurcated members 60 at one edge thereof. Extending beyond the opposite edge of the cover 36 is a catch 62. The catch 62 may be fabricated from plastic or the like and is provided with an opening 64 that receives one of the rods 56 therein to pivotally connect the catch 62 to the cover 36. The top surface of the catch 62 is provided with a recess 66 the opening of which is slightly smaller than the diameter of the rod 56. Accordingly, as the catch 62 is pushed into a horizontal position, the lips forming the opening of the recess 66 are deflected slightly so that the rod 56 enters the recess and is captured therein. A downward pressure on the catch 62 permits the rod to deflect the lips of the opening 66 upwardly and thereby allow the rod to move out of the recess. The catch is provided with a bifurcated end 68.

When it is desired to connect the cover to the basket portion, the hooks 60 are engaged with the desired horizontal member. In other words, if it is desired to connect the cover 36 to the basket portion 34 so that the cover is in its lowest position, the catch 62 is moved downwardly so that it swings freely. The hooks 60 are then engaged about the member 50 and the other end of the cover is swung downwardly until the bifurcated end 68 of the catch 62 engages the opposite end of the member 50. The cover is then pressed downwardly until the rod 56 enters the recess 66 of the catch 62 thereby capturing the rod and retaining the cover in place on the basket portion. The cover may be removed by reversing the process.

Figure 4:
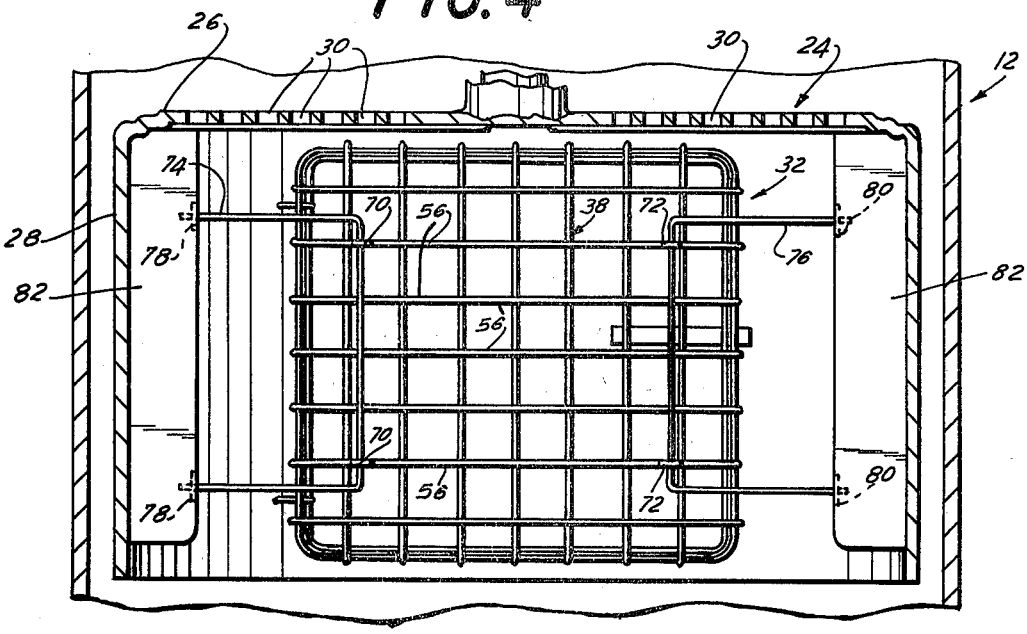
FIG. 4 is a sectional view taken along the line 4—4 of FIG. 3.

Mounting means in the form of blocks and arms are provided for releasably mounting the rack on the drum 24. As shown in FIGS. 3 and 4, selected ones of the rods 56 are provided with laterally spaced aligned hooks 70 adjacent one of the sides of the rack. Additionally, laterally spaced aligned hooks 72 are provided adjacent the other side wall of the rack. The hooks 70 and 72 are positioned on the bottom wall of the basket portion. Pivotally connected to the hooks 70 and 72 are respective U-shaped members 74 and 76. That is, the bight portion of the member 74 is rotatably received in the hooks 70 and the bight portion of the member 76 is rotatably received in the hooks 72. The arms of the member 74 are provided with washers 78 adjacent the ends thereof. In a similar manner, washers 80 are received adjacent the ends of the arms of the member 76. Alternatively, the ends of the respective arms may be enlarged.

Circumferentially spaced radially extending blocks 82 are connected to the peripheral wall 28 of the drum 24. The blocks 82 are provided with spaced keyhole slots 84 adjacent each end thereof, as shown in FIG. 2A. The spacing between the keyhole slots on a block 82 is such that the narrow portion of the slots are equal to the distance between the arms on the U-shaped members 74 and 76.

In practice, when it is desired to place articles in the dryer for a non-tumbling cycle, the rack is removed from the drum and the articles are placed into the basket portion through the open top thereof. The cover is then placed on the basket portion at a height sufficient to exert a pressure on the articles within the basket to prevent relative movement therebetween. That is, if a large number of articles are placed in the basket portion so that the articles extend above the top of the basket portion, the cover 36 is connected to the member 54 of the basket portion. On the other hand, if only a small amount of articles are placed in the basket portion the cover 36 is connected to the member 50 of the basket portion in the manner noted above. Thus, regardless of the amount of articles placed in the basket portion, relative movement or tumbling of the articles received therein as the drum rotates will be prevented.

After the cover has been connected to the basket portion, the rack is inserted into the drum. The arms of the respective U-shaped members 74 and 76 are then inserted into the keyhole slots 84 of the blocks 82. In other words, the members 74 and 76 are fabricated from a metal having sufficient resiliency so that the arms may be spread slightly to permit the enlarged portion or washers at the ends of the arms to enter the enlarged portion of the keyhole slot. Thereafter, the arms are released so that they assume their natural spacing whereupon the arms enter the narrow portion of the keyhole slot and are captured therein because the washers are of greater diameter then the width of the narrow portion of the keyhole slot. Thus, the rack will be retained in the same position relative to the drum as the drum rotates. The open work of the rack will permit the hot air to contact the articles received within the basket portion to thereby permit them to dry.

The rack may be removed from the dryer by reversing the above process. Additionally, when it is desired to execute a conventional tumble drying cycle, the rack may similarly be removed.

Accordingly, a rack has been disclosed which may be removably connected to the drum of a dryer to permit the dryer to execute a non-tumbling cycle with respect to the articles received within the rack.

While a preferred embodiment of the invention has been shown and described herein it will become obvious that numerous omissions, changes and additions may be made in such embodiment without departing from the spirit and scope of the present invention.

What is claimed is:

1. A drying rack for a dryer of the type having a rotating drum for preventing tumbling of the articles received in said rack:

an open-work basket portion for receiving articles, said basket comprising a bottom wall, opposed side walls, a front wall and a rear wall;

a cover for said basket portion;

cooperating closing means on said basket portion and said cover for affixing said cover to said basket portion at a preselected one of a plurality of different heights from said bottom wall;

and mounting means for releasably mounting said rack on the drum to prevent tumbling of said rack as the drum rotates, said basket portion comprising a plurality of spaced upstanding rods in each of said side, front and rear walls; and a plurality of vertically spaced substantially horizontal rods extending about said side, front and rear walls; said closing means comprising bifurcated extensions on one edge of said cover adapted to receive one of said horizontal rods therein, and an extendable bifurcated member at the opposite edge of said cover adapted to engage said one of said horizontal rods to connect said cover to said basket portion at the desired height above said bottom wall.

2. A drying rack as in claim 1, in which said mounting means comprises a pair of U-shaped members hingedly connected to said basket portion, and connecting means adapted to be mounted on the drum for receiving said members therein to connect said rack with the drum.

3. A drying rack as in claim 2, in which said connecting means comprises a pair of blocks connected to the drum, each of said blocks having a pair of spaced keyhole slots therein, the arms of each of said U-shaped member having an enlarged end adapted to be received in said keyhole slot to maintain said rack in position within said drum.

4. A tumble-type dryer comprising a cabinet; a rotatable drum in said cabinet for the tumble drying of articles received therein; and a removable drying rack in said drum for preventing the tumbling of articles therein; said rack comprising a basket portion having an open top, a cover for closing said open top, and mounting means for removably mounting said rack in said drum, said drum having a circular peripheral wall, said mounting means comprising arms for mounting said rack on said drum and for maintaining said rack in spaced relation to said peripheral wall, whereby said rack rotates with said drum.

5. A dryer as in claim 4, in which said basket portion comprises an open-work bottom wall, opposed side walls, front wall and a rear wall; and cooperating closing means on said basket portion and said cover for affixing said cover to said basket portion at a preselected one of a plurality of different heights from said bottom wall.

6. A dryer as in claim 5, in which said basket portion comprises a plurality of spaced upstanding rods in said side, front and rear walls; and a plurality of vertically spaced substantially horizontal rods extending about said side, front and rear walls.

7. A dryer as in claim 6, in which said closing means comprises bifurcated extensions on one edge of said cover adapted to receive one of said horizontal rods therein, and an extendable bifurcated member at the opposite edge of said cover adapted to engage said one of said horizontal rods to connect said cover to said basket portion at a desired height above said bottom wall.

8. A dryer as in claim 4, in which said mounting means comprises a pair of U-shaped members hingedly connected to said basket portion, a pair of blocks connected to said drum, each of said blocks having a pair of spaced keyhole slots therein, the arms of each of said U-shaped members having an enlarged end adapted to be received in said keyhole slot to maintain said rack in position within said drum.

* * * * *